United States Patent [19]

Hofer et al.

[11] 4,101,771

[45] Jul. 18, 1978

[54] ION ELECTRON CONVERTER

[76] Inventors: Wolfgang O. Hofer, Mühlgasse 16, Garching; Jürgen Kirschner, Monheimsallee 62, Aachen, both of Fed. Rep. of Germany

[21] Appl. No.: 710,302

[22] Filed: Jul. 30, 1976

[30] Foreign Application Priority Data

Aug. 4, 1975 [DE] Fed. Rep. of Germany ..... 2534796

[51] Int. Cl.[2] ..... H01J 3/14

[52] U.S. Cl. ..... 250/397; 250/398

[58] Field of Search ..... 250/397, 396 R, 398, 250/399, 309

[56] References Cited

U.S. PATENT DOCUMENTS

| | | | |
|---|---|---|---|
| 2,161,466 | 6/1939 | Henneberg | 250/396 |
| 3,538,328 | 11/1970 | Strausser | 250/399 |
| 3,792,263 | 2/1974 | Hashimoto et al. | 250/399 |

*Primary Examiner*—Alfred E. Smith
*Assistant Examiner*—B. C. Anderson
*Attorney, Agent, or Firm*—Flynn & Frishauf

[57] ABSTRACT

The ion-electron converter is primarily intended for the measurement of small positive ion currents. The essential feature of the converter is its curved conversion electrode which generates an electrostatic field with favorable ion-optical properties; in addition, it avoids high field strength at the conversion electrode, thus reducing spurious field electron emission. Both properties result in an ion detector of high efficiency and sensitivity for positive ions.

13 Claims, 1 Drawing Figure

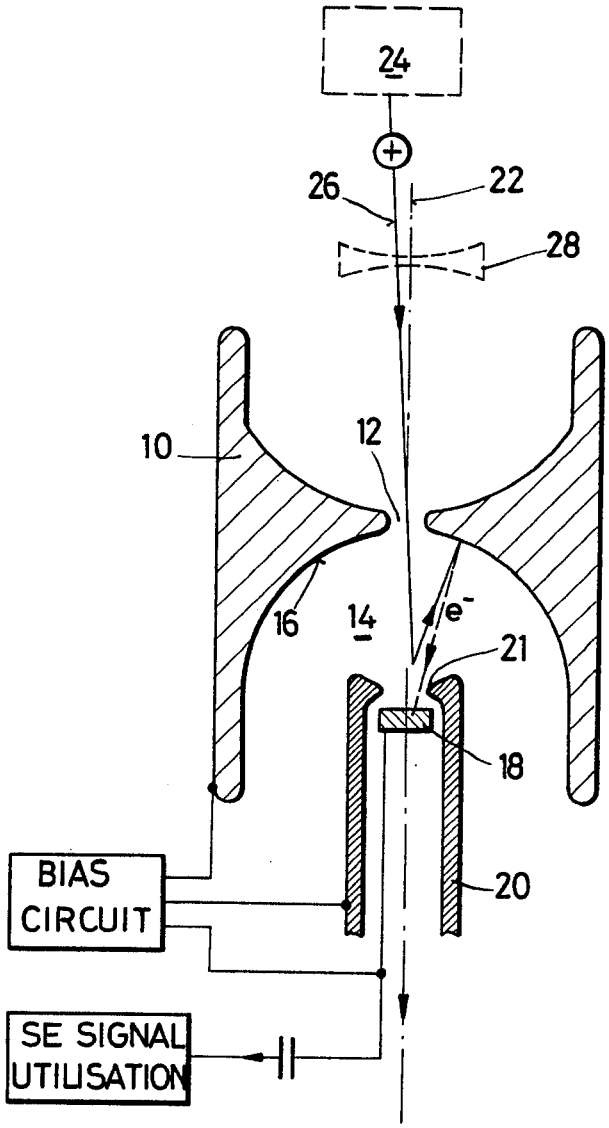
24
26
22
28
10
12
16
14
e⁻
21
18
20
BIAS CIRCUIT
SE SIGNAL UTILISATION

ION ELECTRON CONVERTER

BACKGROUND OF THE INVENTION

Ion-electron converters (IEC) have long been used for detecting ion currents and for investigating the mechanism of ion-induced secondary electron (SE) emission. For the detection of ion currents the ions involved are accelerated onto a solid surface capable of SE emission, i.e., the conversion electrode, and the current of the secondary electrons emitted on ion impact is measured with the aid of an electron detector (ED), e.g. a semiconductor surface barrier detector or a scintillation detector. With ion acceleration voltages of 20 kV and more and oblique ion incidence it is possible to attain high SE emission coefficients, to the effect that ion currents as low as $10^{-22}$A can be measured with the IEC. Ion-electron converters and their applications are described e.g. in Rev.Sci.Instr. 31 (1960) 264

Rev.Sci.Instr. 42 (1971) 1353

Int.J.Mass Spectrom.Ion Phys. 11 (1973) 255.

The known IEC, however, are generally not capable of complete collection of the secondary electrons, and, in addition, emission of field electrons due to the high electric field strength causes high background noise signals.

DESCRIPTION OF THE INVENTION

The main object of the invention is accordingly to provide an ion-electron converter which ensures effective collection of the secondary electrons produced by impinging ions. Briefly, is the ion-electron converter comprises an electron emitting secondary emission electrode having an aperture adapted to be traversed by ions issuing from an ion source and a secondary emissive surface, which, in operation, is averted from said ion source, and which further comprises means for reflecting ions, that have passed through said aperture onto said secondary emissive surface, and a secondary electron detector for detecting the secondary electrons, wherein said secondary emissive surface is concave with respect to the secondary electron detector.

The IEC according to the invention has the advantage of high measuring accuracy since the secondary electrons are reproducibly generated and are almost completely collected, whereby distortion of the signals due to emission of field electrons is essentially avoided. The potential field can easily be optimized, thus yielding higher sensitivity than with known IECs.

The essential feature of the IEC according to the invention is the concave secondary emissive surface. This ensures effective defocussing of the positive ions, thus reducing losses caused by ions reflected back through the entrance aperture; the secondary electrons, on the other hand, are strongly focused in the field of the said secondary emissive surface to the effect that they reach the electron detector as a directed beam in spite of their random emission characteristic. Furthermore, the curved conversion electrode results in low field strength in its vicinity, thus avoiding spurious field emission of electrons and hence improving the sensitivity (detection limit).

The compact design and the high sensitivity make the IEC described specifically useful for the detection of positive ions in high and ultrahigh vacua. Its use is of advantage particularly in mass spectrometry since the mass discrimination effect can be kept small because of the high operating voltages. When scintillation detectors are used for detecting the secondary electrons, counting frequencies of more than 100 MHz can be achieved, while with surface barrier detectors the SE spectrum can be discriminated into individual electron groups.

When used in secondary ion mass spectrometry (SIMS), the IEC according to the present invention allows a distinction between atomic and molecular ion signals, since the probability distribution of the SE-groups is different for atomic and molecular ions.

The IEC according to the invention is, furthermore insensitive to neutral particles and photons, thus again providing for a high signal-to-noise ratio.

DESCRIPTION OF THE PREFERRED EMBODIMENT

The single FIGURE shows a cross-sectional view of a preferred embodiment of an IEC according to the invention. The IEC shown in the drawing comprises a tubular, rotationally symmetrical conversion or secondary electron emission electrode 10, the outer surface of which is cylindrical in shape. The inner wall of the conversion electrode has a constriction 12 to form an axial aperture through which the ions have to pass in order to be detected. The lower part of the inner wall of the conversion electrode, as shown in the drawing, defines a converter chamber 14 and comprises a concave, hemispherical secondary emission surface portion 16, which culminates in the aperture 12, and a downwardly extending lower portion of cylindrical tubular shape. All corners and edges of the SE emission electrode 10 and the other electrodes are rounded as depicted to avoid high electric field concentrations.

An electron detector 18, which may be any device suitable for detecting electrons, e.g. a scintillation detector or a surface barrier detector, is located in the interior of the converter chamber 14.

In the embodiment described, the electron detector 18 is a semiconductor detector which is enclosed by a tubular, coaxial auxiliary electrode 20, the end portion of which that faces the aperture 12 and surrounds the electron detector 18 having a slightly constricted front end forming aperture means 21 similar to a diaphragm to shield the edges of the semiconductor detector. The upper portion of the inner wall adjacent to the aperture 12 is cupshaped and may roughly correspond to half a flat ellipsoid of rotation; and the uppermost portion of the inner wall of 10 of the electrode is of cylindrical, tubular shape.

The entrance side of the SE emission electrode 10 needs not be of the form shown in the drawing. The entrance side or front part of the SE emission electrode serves primarily for ion-optical matching of the IEC to an ion source 24 which may comprise lenses, high-pass filters (which, with the inherent low-pass characteristic of the IEC give a band-pass characteristic) and other ion-optical devices known in the art. The SE emission electrode 10 may thus have in alternative embodiments of the invention (not shown) a plane front surface or a convex front surface facing the ion source 24. The described IEC is operated in an evacuated environment or a rarified atmosphere, e.g. the outer space, as well known in the art.

The IEC described thus has a rotationally symmetric structure relative to an axis 22 passing through the aperture 12.

To detect ions of predetermined acceleration voltage, a retarding field for the ion-reflection has to be produced in front of the electron detector 18 by means of a suitable electrical potential applied to the latter and the auxiliary electrode 20. Thus, the potentials of the electron detector 18 and the auxiliary electrode 20 have to be slightly higher (e.g. a few hundred volts) than the acceleration voltage of the ions to be detected. The potential of the SE electrode 10, on the other hand, has to be below that of the ion acceleration voltage; the difference should generally be at least about 10 kV to ensure effective secondary electron emission.

If, for example, the ions emitted by the ion source 24 have an acceleration voltage of 1 kV, the voltage of the SE electrode 10 may be, for example, about −20 kV, the potential of the auxiliary electrode 20 about +5kV. The voltage of the electron detector 18 may be equal to or slightly lower than that of the auxiliary electrode 20.

To reduce losses due to ions reflected through the aperture 12 without impinging onto the SE emission surface 16, and ion-optical lens 28 which enhances the divergence of the ion beam may be placed between the ion source 24 and the IEC, or the IEC may be placed relative to the ion source 24 as shown so that the ion beam 26 is directed at an angle to the axis 22. Further, the field reflecting the ions may be shaped by deviating from rotational symmetry in such a way that the ions are preliminary reflected to the secondary emission surface 16 and only to a slight extent through the aperture 12.

The conversion electrode 16 needs not be hemispherical, but may also have the shape of a portion of a surface of higher order, e.g. an ellipsoid of rotation. It may be made of any known SE emissive material such as stainless steel, or the SE emission surface 16 may be formed by a coating of a material of high SE emissivity such as CuBe, MgO etc.

The IEC described focuses the secondary electrons onto the electron detector by means of the same potential field that also deflects the ion current to be detected onto the SE emission surface. This results in a high collection efficiency for the secondary electrons and a reduction of the background noise caused by field electrons because the SE emission can occur only in a region of low field strength.

Other embodiments and modifications will be apparent to those skilled in the art.

What is claimed is:

1. An ion electron converter comprising an electrode (10) having an aperture (12) adapted to be traversed by ions from an ion source (24), comprising a secondary electron emissive surface (16) on a first side which, in operation, is averted from said ion source and formed as a smoothly curved concave surface and defining a converter chamber (14);

means for reflecting ions, that have passed through said aperture (12), onto said secondary electron emissive surface (16) including electrode means (20) positioned within the converter chamber (14), and a bias voltage source means biassing the electrode means with respect to the secondary electron emissive surface to reflect ions unto said secondary electron emissive surface;

and a secondary electron detector (18) for detecting secondary electrons ejected from the secondary electron emissive surface (16) by said ions, located within the converter chamber and positioned with respect to the secondary electron emissive surface (16) to be essentially surrounded by at least a portion thereof.

2. The ion electron converter as claimed in claim 1, wherein the electrode means comprises an auxiliary electrode (20) open to the secondary emission surface (16) and enclosing said electron detector.

3. The ion electron converter as claimed in claim 2, wherein the auxiliary electrode is of tubular shape and has aperture means (21) facing said aperture (12).

4. The ion electron converter as claimed in claim 3 wherein said aperture means (21) of said auxiliary electrode (20) facing the aperture (12) forms a constriction (21), said electron detector (18) being closely spaced from said constriction (21).

5. The ion electron converter as claimed in claim 1, wherein the electron detector is a semiconductor detector.

6. The ion electron converter as defined in claim 1 wherein said secondary emissive surface (16) is of at least approximately hemispherical shape and symmetrically disposed to an axis (22) of said aperture (12).

7. The ion electron converter as claimed in claim 1 wherein said emissive surface (16) has the shape of a surface of higher order.

8. The ion electron converter as claimed in claim 6, wherein said electrode (10) has an essentially cylindrical inner wall portion adjacent to said secondary emissive surface (16).

9. The ion electron converter as defined in claim 1 wherein said electrode (10) has a cross-section of a shape similar to an hour-glass.

10. The ion electron converter as claimed in claim 1 wherein the electrode is essentially rotationally symmetrical with respect to an axis (22) of said aperture (12).

11. The ion electron converter as claimed in claim 1 further comprising ion-optical means (28) for enhancing the divergence of the ion beam (26) positioned between said ion source (24) and said aperture (12).

12. The ion electron converter as claimed in claim 1 wherein said ion source is spaced from a central axis (22) normal to an area defined by a circumferential boundary of said aperture (12).

13. The ion electron converter as claimed in claim 4 wherein the bias voltage source means are connected to said auxiliary electrode (20) and to said secondary electron detector (18) and applying bias voltage to said electron detector (18) which is about equal to or slightly lower than that of the auxiliary electrode (20).

* * * * *